US005495648A

United States Patent [19]

Rojdev et al.

[11] Patent Number: 5,495,648

[45] Date of Patent: Mar. 5, 1996

[54] SNAP-IN RECESSED INSERT FOR DISH OF BURIAL CASKET

[75] Inventors: Ilija Rojdev, Fairfield, Ohio; Will Schebler, Batesville, Ind.

[73] Assignee: Batesville Casket Company, Inc., Batesville, Ind.

[21] Appl. No.: 369,350

[22] Filed: Jan. 6, 1995

[51] Int. Cl.[6] ..... A61G 17/00

[52] U.S. Cl. ..... 27/19; 27/17

[58] Field of Search ..... 27/14, 15, 16, 27/17, 4, 19, 35, DIG. 1; 220/431, 469

[56] References Cited

U.S. PATENT DOCUMENTS

| | | | |
|---|---|---|---|
| 2,664,615 | 1/1954 | Hillenbrand et al. . | |
| 2,867,030 | 1/1959 | Hillenbrand . | |
| 2,947,059 | 8/1960 | Hillenbrand . | |
| 2,964,824 | 12/1960 | Hillenbrand . | |
| 3,157,936 | 11/1964 | Hillenbrand . | |
| 3,162,923 | 12/1964 | Kaeser | 27/19 |
| 3,316,608 | 5/1967 | Ross | 27/19 |
| 3,487,513 | 1/1970 | Herring et al. . | |
| 3,831,230 | 8/1974 | Rawlings | 27/19 |
| 4,357,741 | 11/1982 | Winburn et al. . | |
| 4,639,985 | 2/1987 | Craft . | |

*Primary Examiner*—Kien T. Nguyen
*Attorney, Agent, or Firm*—Wood, Herron & Evans

[57] ABSTRACT

A snap-in, recessed insert removably attaches to a casket lid, and a dish removably attaches to the recessed insert, to facilitate the display of different decorative interiors for the casket lid. The recessed insert has a shape which spans the interior of the casket lid and conforms substantially in depth to the inside of the casket lid. The insert snap connects to an internal flange of the casket lid for accurate and repeatable mounting to the lid, without requiring tools. The insert also includes internal structure for retaining a dish inside thereof, including a center depression formed therein for positively seating the middle of the dish to the insert and the casket lid. This recessed insert minimizes the cost and complexity associated with dish changeover and assures accuracy in mounting a dish to the casket lid. Due to its construction, this recessed insert allows the dish components to be shipped separately and connected at the site of display, thereby eliminating an assembly step at the factory, reducing shipping costs and reducing the susceptibility of the puffing to damage during shipping.

21 Claims, 2 Drawing Sheets

SNAP-IN RECESSED INSERT FOR DISH OF BURIAL CASKET

FIELD OF THE INVENTION

This invention relates to burial caskets, and more particularly, to the components mounted to the inside of a hinged lid of a burial casket to provide a decorative look during display.

BACKGROUND OF THE INVENTION

The interior of a burial casket is typically lined with a covering material such as an upholstered fabric. This provides an aesthetic look for the casket when displayed. Inside the lid of the casket, this lining material is often secured to structural components which include a center panel surrounded by a frame. These structural components are usually referred to as a dish, and the frame portion thereof is commonly referred to as "puffing". The term puffing generally describes the raised and curved look of this frame portion. The upholstered fabric which forms the external surface of the dish may be one of a wide variety of colors and/or patterns, so that a customer may select a preferred design and/or pattern. The internal structure of the dish is generally of cardboard or chipboard construction, and the components thereof are mechanically secured together to form a structure which conforms to and is secured within the hollow interior of the casket lid.

To eliminate the need to manufacture a separate casket for each different dish design, the dish is made to be removable from the interior of the casket lid. However, in the past, the mounting of a fabric-lined casket dish to the interior of a casket lid has been a relatively difficult, time consuming and expensive procedure. Prior techniques for this task have included stapling or securing a channel into a cooperating groove formed in a rim around the casket lid, followed by insertion into the plastic channel of the edges, or flaps, of the dish. To ensure retention of the dish within the channel of the lid, a cylindrically-shaped, ropelike strip formed of paper or rubber is then pressed into the channel. The strip is referred to in the industry as a gimp.

The use of a gimp to secure the dish to the lid of a casket has resulted in misalignment of the dish and an unevenness in appearance at locations along the channel where the gimp is improperly seated. These problems become multiplied in situations where, for one reason or another, a variety of different dish designs must be connected to the same casket lid. In these instances, the in place fabric-lined dish must be removed and a new dish installed. Often, this must be done by a funeral director or other representative, who may not be as mechanically adept as the workers in the casket factory, or who may not have the intimate knowledge of the casket structure necessary for repeatable and accurate installation of different dishes to the casket lid.

Prior attempts have been made to eliminate the need for using a gimp to mount a fabric-lined dish to a casket lid. For instance, U.S. Pat. No. 4,639,985, issued to the assignee of this application, discloses use of a flexible channel member which attaches to the interior of a casket lid and releasably retains the flexible edges of the dish. Because of the structure of the channel, and particularly its flexibility due to a spring member, this patent eliminates the need for a gimp. However, this solution still relies upon the use of multiple channels for connecting the dish to the casket lid. If these channels are not seated within a groove around the casket lid in a uniform manner, along their entire lengths, the dish will not be accurately mounted to the casket lid. Inaccurate mounting reflects poorly on the casket manufacturer.

Additionally, the use of multiple channels requires multiple steps when changing to a new dish, provided each of the channels is removed when the dish is changed. Alternatively, if the channels remain in place during changeover to a new dish, it is often necessary to manipulate and/or bend the actual dish structure to free it from within the channels and to retrieve the dish from the interior of the lid. Due to space considerations, it is sometimes difficult and awkward to manipulate the dish from within the channel while the dish remains mounted to the interior of the hingedly connected casket lid. As a result, it is relatively easy to damage the dish during removal from or connection to the lid. With this structure, the components of the dish must be assembled together prior to mounting to the lid.

Additionally, with these prior art dish constructions, the puffing and the center panel are usually secured together prior to shipping. Because the puffing includes four separate raised sections, this requires additional space during shipping, compared to the flat components. Also, in the secured condition, the puffing of the dish is susceptible to damage during shipping.

It is an object of this invention to reduce the time and cost associated with securing and unsecuring a dish to the interior of a casket lid.

It is another object of the invention to eliminate the disadvantages associated with using multiple components, such channels, with or without a gimp, to secure a dish to the interior of a casket lid.

It is still another object of the invention to optimize simplicity in changing the dish of a casket lid, while minimizing the costs associated therewith and the potential for damaging the dish during such changeover.

It is yet another object of the invention to achieve accurate and repeatable mounting of a dish to a casket lid, while at the same time reducing the shipping costs of the dish and the damage susceptibility of the dish during shipping.

The present invention achieves the above-stated objects by using a unitary, recessed insert, preferably of plastic, which snaps into and out of engagement with the lid of a casket, and which removably holds a dish in a central, seated position therein.

This snap-in, recessed insert snaps into the interior of the lid about the entire inside periphery thereof, thereby assuring accurate and repeatable seating of the recessed insert to the interior of the lid in a relatively simple manner, without requiring tools. The recessed insert includes an outwardly extending ledge which engages an internal edge of a flange around the interior of the casket lid, and the recessed insert also includes an outwardly extending rib located opposite the flange edge so that the flange edge is held between the rib and the outer ledge. The snap-in recessed insert also includes an inwardly directed ledge, or inner ledge, which holds corresponding upper edges of the dish. More particularly, this inner ledge holds the upper edges of the four puffing sections of the dish. The dish is shaped to fit within a central depression formed in the recessed insert. The recessed insert provides internal support for the dish and assures accurate positioning of the dish with respect to the casket lid. The recessed insert is sufficiently deformable to allow snap-in connection to and disconnection from the casket lid.

According to a preferred embodiment of the invention, a unitary, recessed insert has a shape which conforms in depth characteristics to the lid of a casket, and the recessed insert includes an outwardly extending ledge and a spaced rib for allowing the insert to be snap fit into the interior of a casket lid via a flange edge around the periphery of the lid. Because of the shape and orientation of the recessed insert, and particularly the outer ledge and rib, with respect to the interior of the casket lid, the snap-in connection can only be achieved if the recessed insert is completely seated within the lid. This snap-in connection assures accurate and repeatable locating of the recessed insert with respect to the lid during securement, every time a recessed insert is installed. The recessed insert also has an inner or inwardly extending ledge which holds the upper edges of the puffing. Finally, as noted above, the recessed insert includes peripheral walls defining a central depression commensurate in depth with that of the casket lid. This central depression helps to center the panel insert of the dish.

Compared to prior designs for attaching a dish to the interior of a casket lid, particularly those involving the use of a gimp, the present invention assures accurate and repeatable positioning of different dish designs within the interior of a casket lid while requiring less time and cost. This is due to the unitary structure of the recessed insert and its snap-in capability with respect to the casket lid, and the ability to readily mount different dishes to the insert. This invention provides accurate and repeatable changeover from one dish to another, with relative simplicity compared to making such a changeover with prior art dish support structures.

Dish changeover may take place with the recessed insert mounted to the casket lid, or separately therefrom. However, when the recessed insert is removed from the casket lid prior to replacing a seated dish with a substitute dish, replacement is more convenient because it occurs outside of the physical restrictions imposed by the casket and its hingedly connected lid, thereby reducing the susceptibility to damaging the dish during changeover.

Because of the shape and configuration of the recessed insert of this invention, the dish components may be shipped separately, in an unsecured condition, and then separately mounted to the recessed insert. This eliminates an assembly step at the factory, reduces shipping costs because the puffing sections remain flat until installation and further reduces the susceptibility to damage for the puffing sections during shipping.

To install the unsecured dish components, a backing member shaped to fit within the central depression of the recessed insert is placed therein. Four separate puffing sections are then located around and preferably secured to the perimeter of the backing member, via inner folded edges. These folded edges are preferably retained by an inwardly directed rib located adjacent the bottom of the central depression of the recessed insert. The puffing sections may be secured to the backing member, either before or after placement of the backing member in the central depression. For each puffing section, the upper edge thereof is folded outwardly to form an arc, and the upper edge is located and secured by the inner ledge of the recessed insert. A panel insert is then placed within the central depression, in contact with the backing member, to hold the puffing sections in place.

The recessed insert of this invention may be configured to retrofit various different types of casket lids, so long as the outer ledge and outer rib are sized and shaped to snap connect to a flange or other supporting structure of the lid. The recessed insert may also be used with either metal or wood caskets.

These and other features of the invention will be more readily understood in view of the following detailed description and the drawings

DETAILED DESCRIPTION OF THE INVENTION

Figure 1:
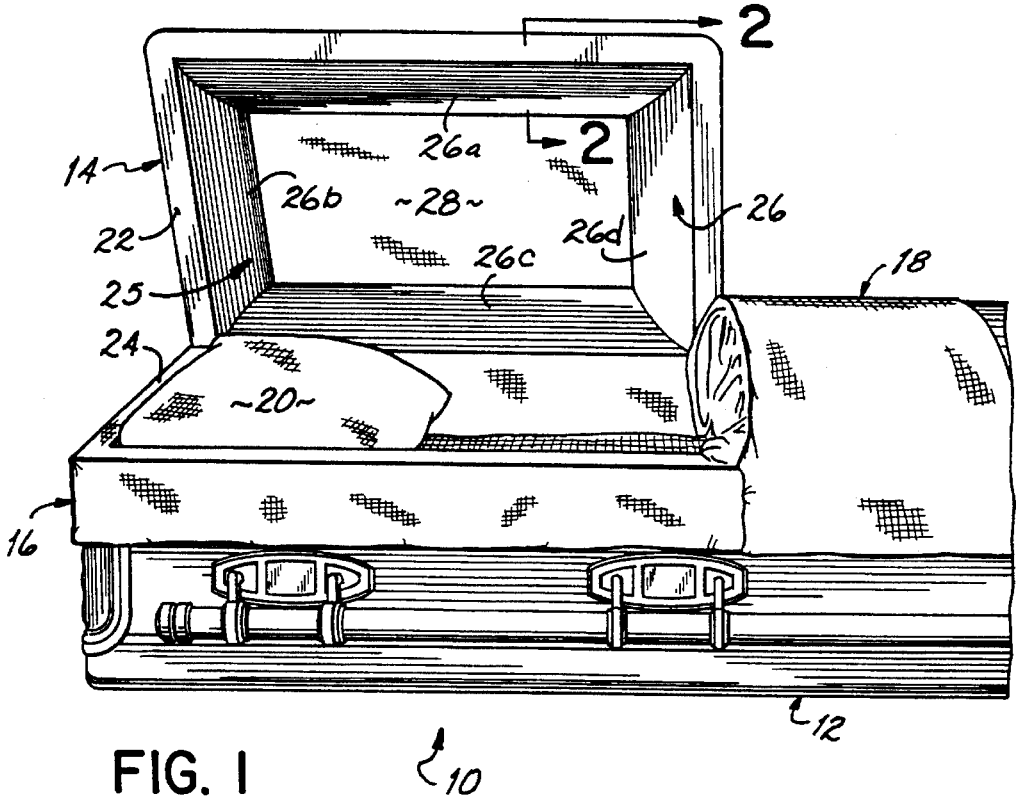
FIG. 1 is a side perspective view of a casket with a lid thereof located in an open position, so that the casket interior is exposed for viewing.

FIG. 1 depicts a burial casket 10, of wood or metal, which generally includes a body 12 and hingedly connected lid 14, or cap. The lid 14 may be the full length of the casket, or a half length, as shown in the Figure. The principles of this invention relate to either structure. In FIG. 1, the lid 14 is open, which is common for displaying the casket 10 by itself to customers or at an actual visitation service. With the lid 14 in the open position, the interior thereof is exposed to full view. Other decorative elements of the casket 10 which are in view during display include a big body 16 which overlies the rim of the body 12 and an overthrow 18 which overlies the closed portion of the lid 14 of the casket 10. FIG. 1 also shows a pillow 20 and a circumferential flange 22 of the lid 14 which substantially engages a corresponding circumferential flange 24 of the body 12 when the casket 10 is closed.

The principles of this invention relate to the structural components connectable to the interior of the lid 14, or connectable within the circumferential flange 22. The primary component which is partially exposed to view when the lid 14 is open is generally referred to as the dish 25. More specifically, the dish 25 includes a framing, or border 26 which is covered with a fabric. This border 26 is often referred to as the puffing. More specifically, the puffing 26 is rectangular and includes four sections designated by reference numerals **26*a*, 26*b*, 26*c* and 26*d*, though other shapes could also be used, if desired. These puffing sections 26*a*–26*d* have inner ends or edges which secure to a backing member or backing panel 30. The puffing 26 surrounds a panel insert 28 which also is covered with a fabric, preferably with a fabric having a particular design matching that of the puffing 26. The panel insert 28 may be rigidly secured to the backing member 30 and puffing sections 26*c*–26*d*, and covered with the same upholstered fabric lining. Alternatively, for additional variety, the panel insert 28 may be removably connected to the other components of the dish 25**, and it may have a different upholstered design and/or fabric.

As described above, it is often desirable to change the interior look of the lid 14. It is thus important to be able to remove the dish 25, i.e. the puffing 26, the backing member 30 and the panel insert 28, with relative ease, so that they may be readily replaced with a different dish 25 having the same size. In addition to the ease in substituting one dish 25 design for a dish 25 of a different design, it is also important that each of the dish 25 designs fits within the lid 14 in the exact same manner. Otherwise, if the fit is inconsistent or offset, the appearance of the casket will be unacceptable, and the quality of workmanship of the entire casket may be subject to question.

Figure 2:
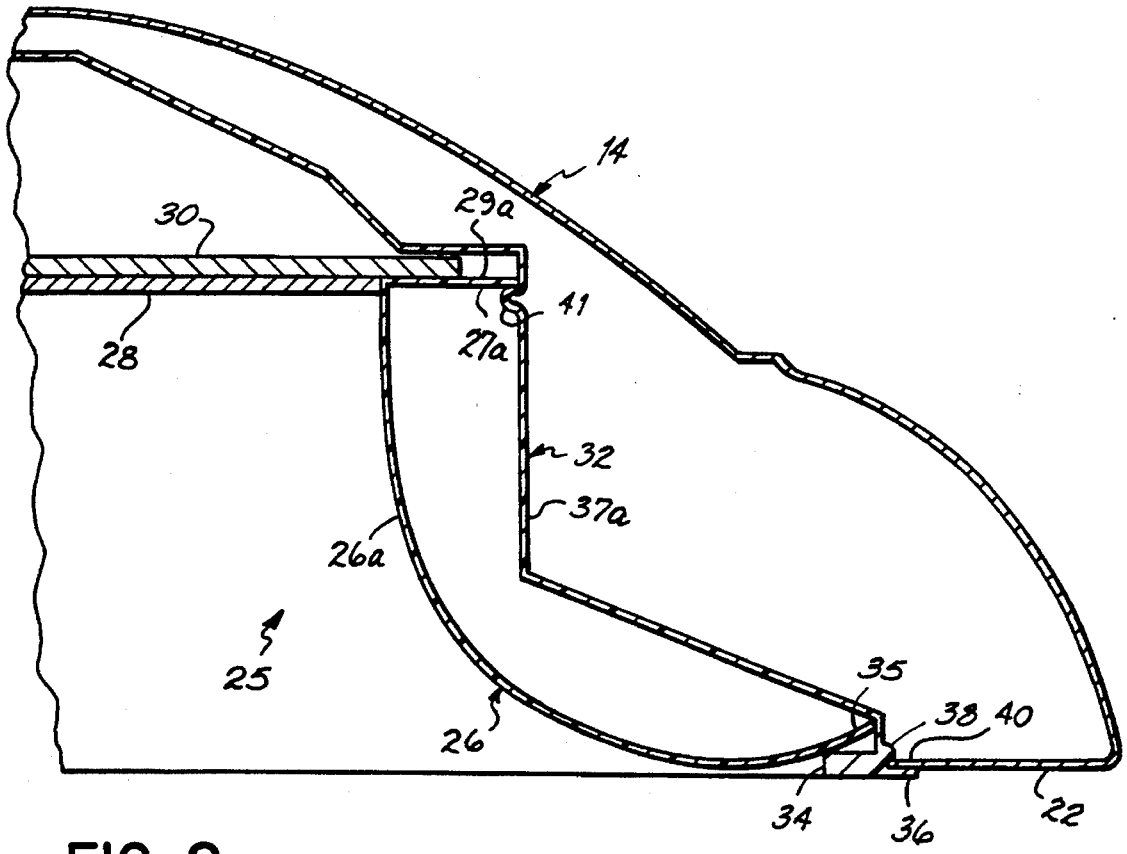
FIG. 2 is a cross-sectional view taken along lines 2—2 of FIG. 1.

According to the invention, the puffing 26, the backing member 30 and the panel insert 28 removably fit within a plastic, molded recessed insert 32 which in turn removably fits within the lid 14 via a snap-in connection. FIG. 2 shows in greater detail the relationship among the snap-in recessed insert 32, the puffing 26, the backing member 30 and the panel insert 28. More particularly, the recessed insert 32 includes an inner ledge 34 which extends inwardly to hold an upper edge 35*a* of puffing section 26*a*, so that the puffing section 26*a* is bent outwardly and arcuately with respect to the center of the lid 14.

Opposite the inner ledge 34, the recessed insert 32 includes an outer ledge 36 which extends outwardly to engage and cover a free inside edge 40 of the circumferential flange 22. Preferably, the outer ledge 36 covers the free edge 40 about the entire periphery of the lid 14. The recessed insert 32 also includes either one peripherally continuous rib 38 or a plurality of discontinuous ribs 38 located opposite the outer ledge 36, with the free inside edge 40 residing therebetween. The one or more ribs 38 and the outer ledge 36 cooperatively capture the free edge 40 of the lid 14, thereby to securely hold the recessed insert 32 within the lid 14, regardless of whether the lid 14 is in an open or closed position. The plastic composition of the recessed insert 32 allows sufficient deformation to allow the ribs 38 to move within the edge 40 during connection to the lid 14, so that no tools are required. If the recessed insert 32 is seated to the lid 14, it will necessarily be centered and held in the exact desired position.

FIG. 2 shows that the recessed insert 32 has a depth almost as great as that of the lid 14, despite having a slightly different cross-sectional shape. FIG. 2 also shows in more detail the cross-sectional structure of the puffing 26, the backing member 30 and the panel insert 28. More specifically, FIG. 2 shows that puffing section 26*a* of puffing has an outwardly folded flap, designated by reference numeral 27*a*. The flaps of the other puffing sections 26*b*, 26*c* and 26*d* are identical in construction, and thus are not described. Flap 27*a* has an inwardly directed surface portion 29*a* which contacts the backing member 30. Preferably, the folded flaps 27*a*, 27*b*, 27*c* and 27*d* are secured to the backing member 30 via adhesive, staples or any other mechanical or structural securement mechanism. The backing member 30 and/or the puffing sections 26*a*–26*d* may include indica and score lines, respectively, to facilitate folding and securing at the correct position.

This surface portion 29*a* is preferably retained by an inwardly directed rib 41 located on the inside surface of the peripheral walls 37 of the recessed insert 32. FIG. 2 shows that the edge of the backing member 30 does not extend all the way to the peripheral sidewall 37*a*.

The backing member 30 provides internal support for the puffing 26, and the backing member 30 also supports the panel insert 28, regardless of whether the panel insert 28 is removably connected thereto or permanently connected thereto. The backing member 30 is sized and shaped to fit within a central depression defined by four peripheral sidewalls 37*a*– 37*d* of the recessed insert 32. The peripheral walls 37 orient and seat the backing member 30 and the puffing sections 26*a*–26*d* of the dish 25 with respect to the recessed insert 32, so that the dish 25 is always accurately and repeatably centered with respect to recessed insert 32.

Figure 3:
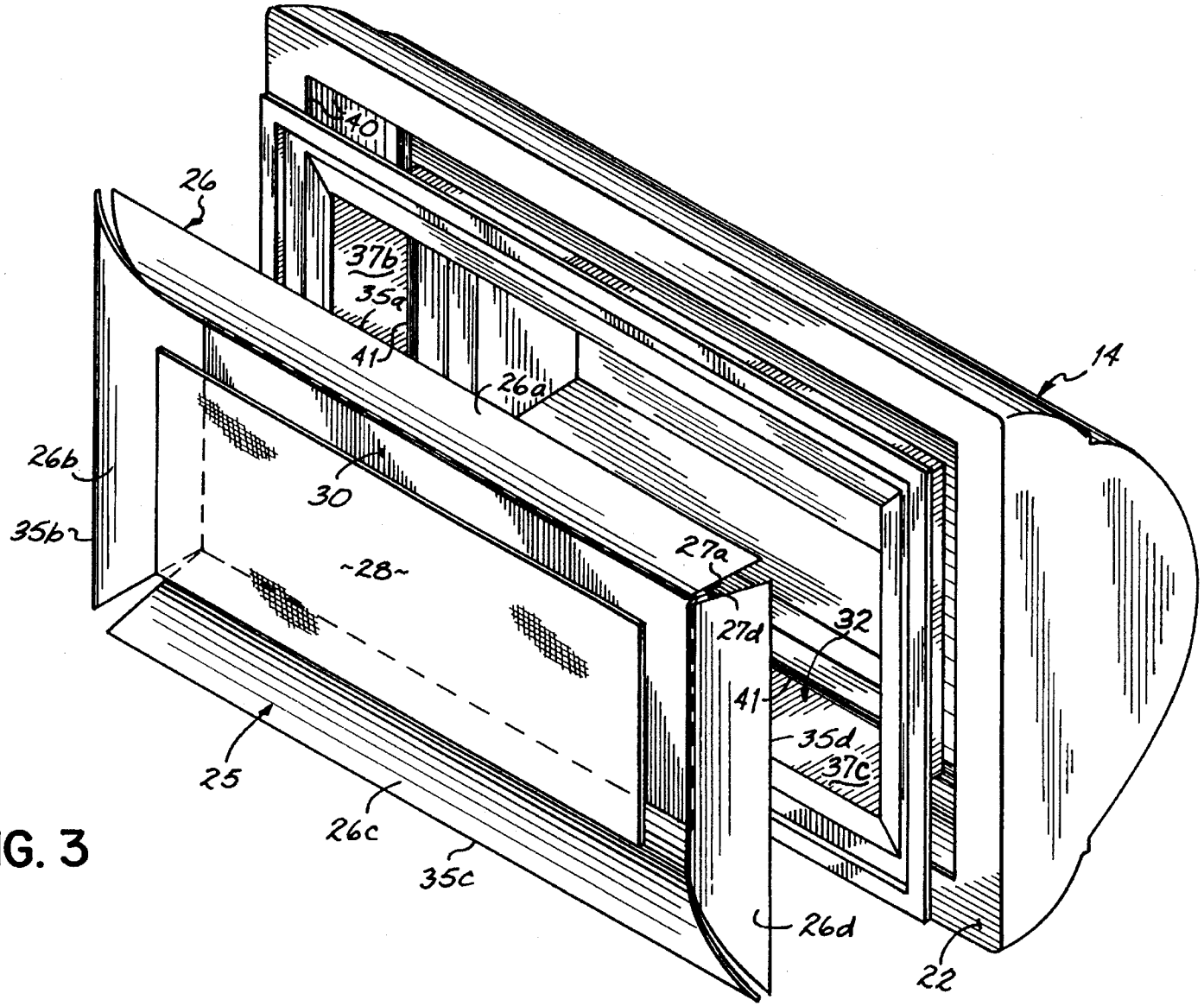
FIG. 3 is a disassembled perspective of the interior components of a lid of a burial casket constructed in accordance with a preferred embodiment of the invention.

FIG. 3 shows in greater detail the relative positions of the recessed insert 32, the puffing 26, the backing member 30 and the panel insert 28. FIG. 3 also shows that the lateral inside edges of the respective sections 26*a*, 26*b*, 26*c* and 26*d* of the puffing 26 are not connected to each other. This permits movement of the puffing sections 26*a*–26*d* relative to the panel insert 28 and the backing member 30, to locate the respective upper edges 35*a*, 35*b*, 35*c* and 35*d* within the inner ledge 34 of the recessed insert 32.

In addition to not being interconnected along their side edges, the puffing sections 26*a*–26*d* do not have to be secured together prior to shipping. Accordingly, the puffing sections 26*a*–26*d* may be shipped flat, reducing shipping costs and minimizing the possibility of damage. This also eliminates a dish assembly step at the factory.

The removable, recessed insert 32 is preferably made of plastic, via thermoforming, such as injection molding, blow molding or compression molding, etc. The plastic must be flexible enough so that sufficient deformation is permitted to allow the recessed insert 32 to be snap-fit to the inside of the lid 14. However, the recessed insert 32 must also be sufficiently rigid to retain its position within the lid 14 while holding the dish 25 in a relatively rigid position, during opening and closing of the lid 14.

In use, the recessed insert 32 is snap-fit within the lid 14 of the casket 10, and then any desired dish 25 may be removably inserted, or connected thereto. Thereafter, if it is desired to change the look of the interior of the lid 14, the dish 25 may be removed from the recessed insert 32 and a different dish 25 substituted therein, or simply a new panel insert 28 substituted within the same puffing 26. Changing over to a new dish will require removing the upper edges 35*a*–35*d* of puffing sections 26*c*–26*d*, respectively, from within the inner ledge 34, and retrieving the dish 25 from the recessed insert 32.

If desired, the recessed insert 32 itself may simply be removed from the lid 14, with the dish 25 remaining therein. Then, the dish 25 may be removed from the recessed insert 32, a second dish 25 may be secured to the recessed insert 32, and the recessed insert 32 then reconnected to the interior of the lid 14 with the new dish 25 located therein. In this manner, the dish 25 is less susceptible to damage during changeover, because the dish 25 may be removed from the recessed insert 32 away from the physical space restrictions imposed by the casket lid 14.

As yet another alternative, a second recessed insert 32 may be used, with a second dish 25 already mounted therein, so that changeover to a new look or design occurs simply by removing one recessed insert 32 and its contents and substituting another. If yet a third dish 25 must be viewed, it may be connected to the recessed insert 28 which is not in use, separate from the casket lid 14.

If the components of the dish 25 are shipped separately and separately mounted to the recessed insert 32, the backing member 30 is mounted first, followed by securement thereto of the puffing sections 26*a*–26*d*. Alternatively, the puffing sections 26*a*–26*d* may be secured to the backing member 30 prior to mounting in the recessed insert 32. Once installed, the rib 41 holds this structure in place. Thereafter, the panel insert 28 is mounted therein, and the edges thereof hold the puffing sections 26*a*–26*d* in place. After initial installation, the three initially separate components of the dish 25 may be permanently secured together. This may be done inside or outside of a recessed insert 32. If desired, the backing member 30 and the puffing 26 may also be only temporarily secured together, if at all.

With each of these alternatives, the snap-in recessed insert 32 of this invention results in less disconnection and connection of multiple mechanical parts. Thus, the invention greatly simplifies the display of different designs for the interior of a casket 10. Also, because of the manner in which the snap-in recessed insert 32 seats within the lid 14, and the manner in which the dish 25 components seat within and are secured to the recessed insert 32, this invention assures that different interior designs are displayed with a high degree of repeatability and accuracy.

While a preferred embodiment of the invention has been described, applicants do not wish to restrict or in any way limit the scope of the appended claims to such detail. Additional advantages and modifications will be readily apparent to those skilled in the art. The invention in its broader aspects is therefore not limited to the specific details, representative apparatus and method, and illustrative example shown and described. Accordingly, departures may be made from such details without departing from the spirit or scope of applicants' general inventive concepts.

We claim:

1. In a burial casket having a lid hingedly connected to a body, the lid having a hollow internal side substantially surrounded by a flange and an interior therein, the interior comprising:

a recessed insert connectably received within the internal open side of the lid, the recessed insert having an outwardly extending ledge engaging the flange and the recessed insert further having an inwardly extending ledge;

a dish removably mounted within the recessed insert, the dish including a puffing with a plurality of puffing sections, each of the puffing sections having an inner edge and an outer edge, the outer edges of the puffing sections held in place by the inwardly extending flange of the recessed insert;

the dish further including, a backing member located adjacent to and supporting the inner edges of the puffing sections, and a panel insert held within the puffing sections adjacent the backing member, whereby the border, the backing member and the panel insert are removable from the recessed insert and the recessed insert is removable from the lid.

2. The burial casket of claim 1 wherein the panel insert is removable from within the puffing sections of the dish.

3. The burial casket of claim 2 wherein the backing member and the puffing sections are secured together.

4. The burial casket of claim 1 wherein the lid has four walls, the flange surrounds the four walls of the lid, the recessed insert has four corresponding sidewalls and there are four corresponding puffing sections.

5. The burial casket of claim 4 wherein each of the puffing sections has two free side edges, and each of the respective puffing sections is curved when the outer edge thereof is held by the inwardly extending flange of the recessed insert.

6. The burial casket of claim 1 wherein the inner edges of the puffing sections include folded portions oriented parallel with the backing member.

7. The burial casket of claim 6 wherein the folded portions of the puffing sections are secured to the backing member.

8. The burial casket of claim 6 wherein the recessed insert has a plurality of inner sidewalls defining a center depression, and further comprising:

an inwardly directed rib retaining the folded portions of the puffing sections.

9. The burial casket of claim 1 wherein the recessed insert further comprises:

a rib located opposite the outwardly extending ledge, with the flange of the lid residing therebetween, thereby to securely mount the recessed insert to the lid.

10. The burial casket of claim 9 wherein the recessed insert has sufficient flexibility to permit the deformation necessary to seat the flange between the rib and the outwardly extending ledge.

11. The burial casket of claim 10 wherein the recessed insert is molded plastic.

12. The burial casket of claim 9 wherein the lid has four sidewalls, the recessed insert has four corresponding sidewalls and the rib engages the flange on at least two sides.

13. The burial casket of claim 12 wherein the rib is discontinuous.

14. A decorative interior for the inside surface of a lid of a burial casket, the lid hingedly connected to a body of the casket and including a peripheral flange substantially surrounding the inside surface thereof, the interior comprising:

a recessed insert removably connectable to the flange of the lid, the recessed insert adapted for substantially covering the inside surface of the lid and including a central depression bounded by sidewalls; and a dish removably connected to the recessed insert and substantially covering the recessed insert from view, the dish including a backing member located within the central depression, a plurality of puffing sections held within the recessed insert around the backing member and a panel insert seated and centered within the puffing sections and adjacent the backing member, the dish providing an aesthetic visual appearance for the lid of the casket when on display in the open position.

15. The invention of claim 14 wherein the backing member is secured to each of the puffing sections.

16. A decorative interior for the inside surface of a lid of a burial casket, the lid hingedly connected to a body of the casket and including a peripheral flange substantially surrounding the inside surface thereof, the interior comprising:

a recessed insert removably connectable to the flange of the lid, the recessed insert adapted for substantially covering the inside surface of the lid and including a central depression bounded by sidewalls, the insert further including, an outwardly directed ledge and an outwardly directed rib adapted to cooperatively snap into the peripheral flange, thereby to hold the recessed insert to the lid, and an inwardly directed ledge, the inwardly directed ledge and the central depression adapted to removably hold a dish.

17. The invention of claim 16 and further comprising:

a rib extending inwardly from the insert in spaced relation from the inwardly directed ledge, the inwardly directed ledge and rib adapted to retain first and second edges, respectively, of a puffing section.

18. A method of mounting a decorative interior to the inside of a lid of a burial casket, the lid hingedly connected to a body of the casket and including a peripheral flange substantially surrounding the inside surface thereof, comprising the steps of:

connecting a recessed insert to the inside of the lid via the making of a snap fit interconnection between an outwardly extending ledge and rib of the recessed insert and the peripheral flange, the recessed insert having peripheral walls defining a central depression and the recessed insert substantially covering the inside surface of the lid; and mounting a dish to the recessed insert, within the central depression.

19. The method of claim 18 wherein the mounting step further comprises:

placing a backing member of the dish within the central depression;

retaining puffing sections of the dish within the central depression, with lower edges thereof located adjacent the backing member and upper edges thereof held by an inwardly extending ledge of the recessed insert; and locating a panel insert inside the central depression and within the puffing sections, adjacent the backing member, and in a manner which retains the lower edges of the puffing sections.

20. The method of claim 19 wherein the placing, retaining and locating steps occur consecutively, and not at the same time.

21. The method of claim 19 wherein the lower edges of the puffing sections are retained by a rib which extends inwardly from the recessed insert, spaced from the inwardly extending ledge.

* * * * *